US007967734B1

(12) United States Patent
Damian et al.

(10) Patent No.: US 7,967,734 B1
(45) Date of Patent: Jun. 28, 2011

(54) EXERCISE BIKE AND ELECTRICITY PRODUCING COMBINATION APPARATUS

(76) Inventors: Mike Damian, Washougal, WA (US); Jennifer Damian, Washougal, WA (US)

( * ) Notice: Subject to any disclaimer, the term of this patent is extended or adjusted under 35 U.S.C. 154(b) by 0 days.

(21) Appl. No.: 12/753,151

(22) Filed: Apr. 2, 2010

(51) Int. Cl.
*A63B 22/12* (2006.01)
*A63B 69/16* (2006.01)
*A63B 71/00* (2006.01)

(52) U.S. Cl. ..... 482/62; 482/2

(58) Field of Classification Search ..... 482/1–2, 482/51–52, 57–65, 79–80, 133–137, 142, 482/904, 910; 601/23, 33–36; D21/662–667, D21/697; *A63B 22/12, 69/16, 71/00*
See application file for complete search history.

(56) References Cited

U.S. PATENT DOCUMENTS

| | | | | | |
|---|---|---|---|---|---|
| 3,057,201 | A | * | 10/1962 | Jaeger | 73/379.07 |
| 3,189,344 | A | * | 6/1965 | Swarts | 482/57 |
| 4,612,447 | A | | 9/1986 | Rowe | |
| 4,717,146 | A | * | 1/1988 | Nohara | 482/62 |
| 5,160,305 | A | * | 11/1992 | Lin | 482/138 |
| 5,232,422 | A | * | 8/1993 | Bishop, Jr. | 482/57 |
| 5,486,148 | A | * | 1/1996 | Johnston | 482/57 |
| 5,569,128 | A | * | 10/1996 | Dalebout | 482/57 |
| 6,229,224 | B1 | | 5/2001 | Gagne | |
| 6,702,722 | B1 | * | 3/2004 | Arroyo, Jr. | 482/62 |
| 6,905,440 | B2 | | 6/2005 | Heppert | |
| 6,987,327 | B1 | | 1/2006 | Lucatero | |
| 7,090,620 | B1 | | 8/2006 | Barlow | |
| 7,253,534 | B2 | | 8/2007 | Vasilovich | |
| 2002/0147079 | A1 | | 10/2002 | Kalnbach | |
| 2007/0243975 | A1 | * | 10/2007 | Gearon | 482/57 |

* cited by examiner

*Primary Examiner* — Nicholas D Lucchesi
*Assistant Examiner* — Oren Ginsberg

(57) ABSTRACT

A exercise bike and electricity producing combination apparatus includes a frame with a central support forming a triangle with a first leg, a second leg and base. A first footing is attached to a juncture of the first leg and second leg, a second footing is attached to a juncture of the second leg and base, and a third footing is attached to a juncture of the first leg and base. A housing is mounted on the central support. A crank is mounted on the housing. A seat is removably couplable to the housing when the first and second footings are positioned on a floor surface to position the seat above the crank. A chair is removably couplable to the housing when the first and third footings are positioned on the floor surface to position the chair facing the second leg to allow the crank to be actuated by hand.

7 Claims, 3 Drawing Sheets

EXERCISE BIKE AND ELECTRICITY PRODUCING COMBINATION APPARATUS

BACKGROUND OF THE DISCLOSURE

Field of the Disclosure

The disclosure relates to exercise bike devices and more particularly pertains to a new exercise bike device for exercising a person's arms and legs and which may also be utilized for producing electricity.

SUMMARY OF THE DISCLOSURE

An embodiment of the disclosure meets the needs presented above by generally comprising a frame with a central support forming a triangle and including a first leg and a second leg attached to each other and a base attached to and extending between the first and second legs. A first juncture is defined at a juncture of the first and second legs. A second juncture is defined at a juncture of the second leg and the base and a third juncture is defined at a juncture of the first leg and the base. A first footing is attached to the first juncture and a second footing is attached at the second juncture to retain the central support in a vertical orientation. Each of the first and second footings is orientated perpendicular to a plane of the central support. A third footing is attached to the third juncture and is orientated parallel to the first footing. The third footing supports the central support in a vertical orientation when the second footing is vertically positioned over the first footing. A housing is mounted on the central support. A crank is mounted on the housing. A seat is removably couplable to the housing when the first and second footings are positioned on a floor surface to position the seat above the crank. A chair is removably couplable to the housing when the first and third footings are positioned on the floor surface to position the chair facing the second leg to allow the crank to be actuated by hand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
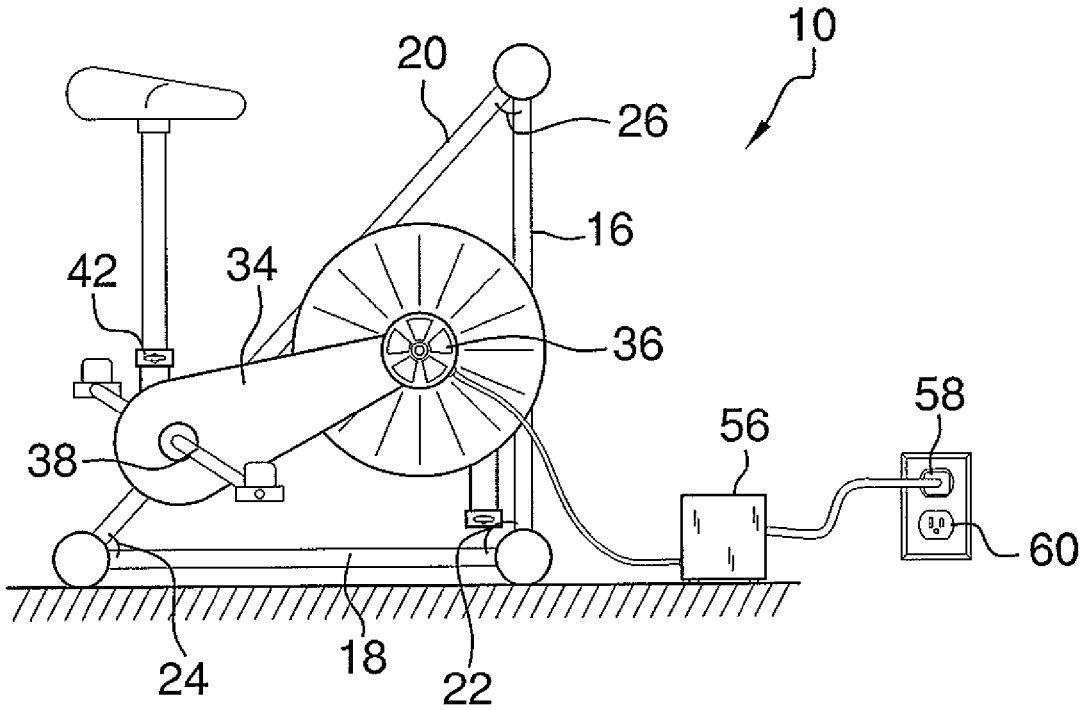
FIG. 1 is a side view of a exercise bike and electricity producing combination apparatus according to an embodiment of the disclosure.
Figure 2:
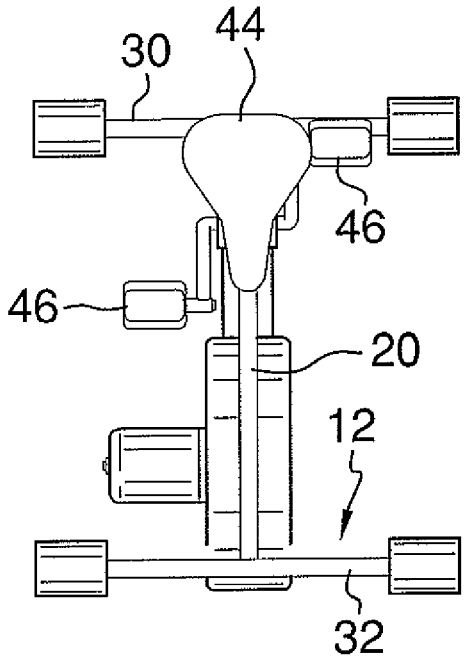
FIG. 2 is a top view of an embodiment of the disclosure.
Figure 3:
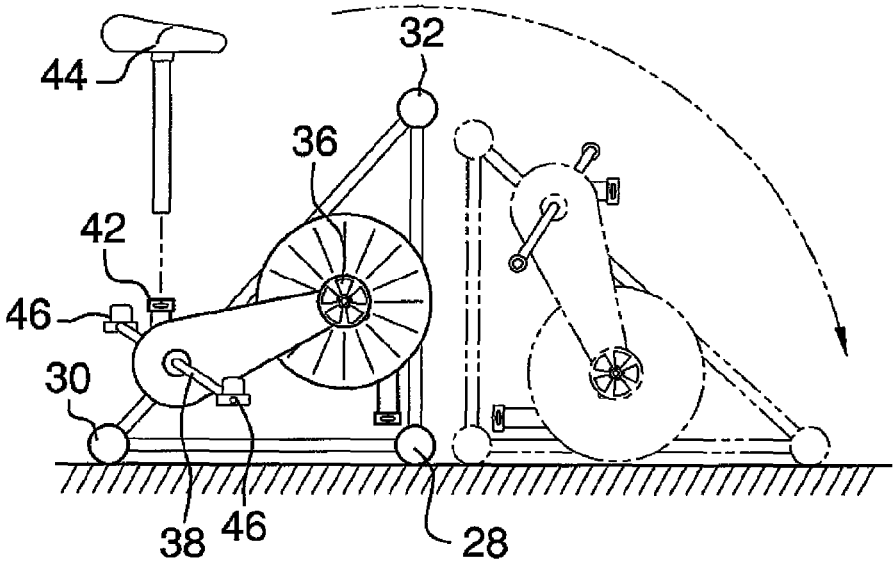
FIG. 3 is a side view of an embodiment of the disclosure.

With reference now to the drawings, and in particular to FIGS. 1 through 5 thereof, a new exercise bike device embodying the principles and concepts of an embodiment of the disclosure and generally designated by the reference numeral 10 will be described.

As best illustrated in FIGS. 1 through 5, the exercise bike and electricity producing combination apparatus 10 generally comprises a frame 12 that includes a central support 14 forming a right triangle 14 with a first leg 16 and a second leg 18 attached to each other at a right angle. A base 20 is attached to and extends between the first 16 and second 18 legs. A first juncture 22 is defined at a juncture of the first 16 and second 18 legs, a second juncture 24 is defined at a juncture of the second leg 18 and the base 20, and a third juncture 26 is defined at a juncture of the first leg 18 and the base 20.

A first footing 28 is attached to the first juncture 22 and a second footing 30 is attached at the second juncture 24 to retain the central support 14 in a vertical orientation. Each of the first 28 and second 30 footings is orientated perpendicular to a plane of the central support 14. A third footing 32 is attached to the third juncture 26 and is orientated parallel to the first footing 28. The third footing 32 supports the central support 14 in a vertical orientation when the second footing 30 is vertically positioned over the first footing 28. The first 28, second 30 and third 32 footings have same structure with respect to each other and each extends laterally away in opposite directions from the central support 14.

A housing 34 is mounted on the central support 14. A generator 36 is mounted to the housing 34. A crank 38 is mounted on the housing 34 and. The crank 38 is positioned adjacent to the second juncture 28 and is mechanically coupled to the generator 36 to generate electricity when the crank 38 is rotated. The crank 38 may be coupled to the generator 36 in a conventional manner such as a belt or chain. A wheel 40 may be mounted within the housing 34 and mechanically coupled to the crank 38 as well. Such wheels are know with conventional, stationary exercise bikes and may include a weighted wheel, a wind resistance wheel, and the like which may have an adjustable resistance.

A vertical mount 42 is attached to and extends upwardly from the housing 34. A seat 44 is removably couplable to the vertical mount 42 to position the seat 44 above the crank 38. A pair of pedals 46 is removably couplable to the crank 38. The pedals 46 are engageable by the feet of a person positioned on the seat 44. The third footing 32 is grippable by a person seated on the seat 34 so that it can be used as a handle.

Figure 4:
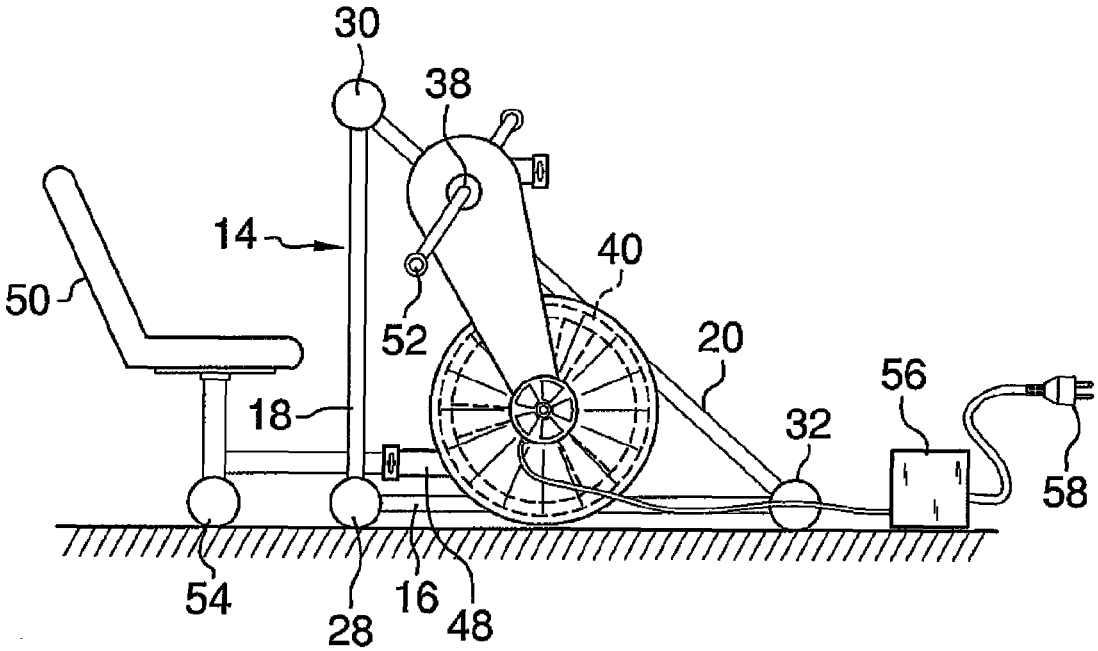
FIG. 4 is a side view of an embodiment of the disclosure.
Figure 5:
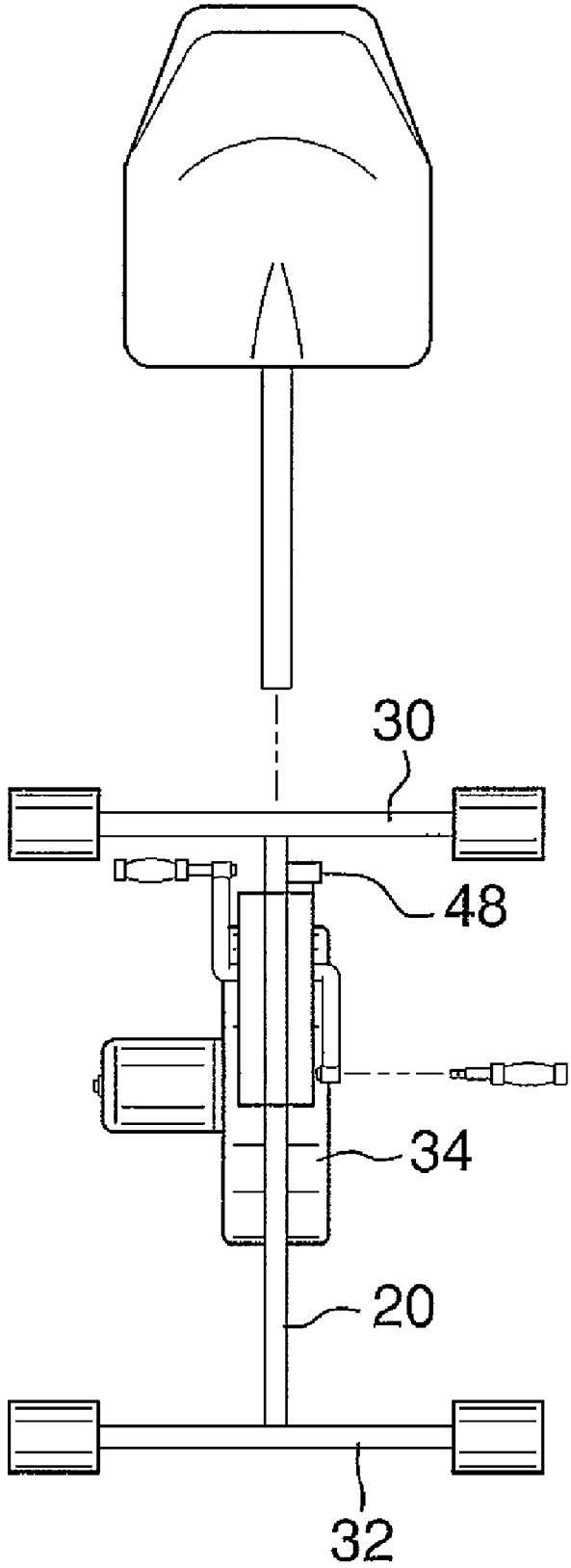
FIG. 5 is a top view of an embodiment of the disclosure.

A horizontal mount 48 is attached to the housing 34. The horizontal mount 48 is horizontally orientated and extends toward the first juncture 24 when the first 28 and third 32 footings are positioned on a floor surface as shown in FIG. 4. A chair 50 is removably couplable with the horizontal mount 48 when the horizontal mount 48 is horizontally orientated so that the chair 50 faces the crank 38. A pair of hand grips 52 is removably couplable to the crank 38 and are grippable by a person seated on the chair 50. The chair 50 may including a brace 54 to engage the floor.

An inverter 56 is electrically coupled to the generator to convert direct current produced by the generator 36 into alternating current. A male electrical plug 58 is electrically coupled to the inverter 56 and is configured to be plugged into an electrical outlet 60. This allows a person to generate electricity that can be diverted to the power system of a dwelling.

In use, the apparatus 10 is used for exercising a person's legs when in the configuration shown in FIG. 1 and can be used to exercise a person's arms when in the configuration shown in FIG. 4. While the person exercises, they may also generate electricity.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A modular exercise bicycle apparatus comprising:

a frame including;

a central support forming a triangle and including a first leg and a second leg attached to each other and a base attached to and extending between said first and second legs, a first juncture being defined at a juncture of said first and second legs, a second juncture being defined at a juncture of said second leg and said base, a third juncture being defined at a juncture of said first leg and said base;

a first footing being attached to said first juncture and a second footing being attached at said second juncture to retain said central support in a vertical orientation, each of said first and second footings being orientated perpendicular to a plane of said central support;

a third footing being attached to said third juncture and being orientated parallel to said first footing, said third footing supporting said central support in a vertical orientation when said second footing is vertically positioned over said first footing;

a housing being mounted on said central support;

a crank being mounted on said housing;

a seat being removably couplable to said housing when said first and second footings are positioned on a floor surface to position said seat above said crank;

a chair being removably couplable to said housing when said first and third footings are positioned on the floor surface to position said chair facing said second leg to allow said crank to be actuated by hand.

2. The apparatus according to claim 1, further including a generator being mounted to said housing and being mechanically coupled to said crank to generate electricity when said crank is rotated.

3. The apparatus according to claim 2, further including an inverter being electrically coupled to said generator to convert direct current produced by said generator into alternating current, a male electrical plug being electrically coupled to said inverter and being configured to be plugged into an electrical outlet.

4. The apparatus according to claim 1, further including a vertical mount being attached to and extending upwardly from said housing, said seat being removably couplable to said vertical mount, a pair of pedals being removably couplable to said crank, said pedals being engageable by a person seated on said seat, said third footing being grippable by the person seated on said seat.

5. The apparatus according to claim 4, further including a horizontal mount being attached to said housing, said horizontal mount being horizontally orientated and extending toward said first juncture when said first and third footings are positioned on the floor surface, said chair being removably couplable with said horizontal mount when said horizontal mount is horizontally orientated, a pair of hand grips being removably couplable to said crank and being grippable by a person seated on said chair.

6. The apparatus according to claim 1, further including a horizontal mount being attached to said housing, said horizontal mount being horizontally orientated and extending toward said first juncture when said first and third footings are positioned on the floor surface, said chair being removably couplable with said horizontal mount when said horizontal mount is horizontally orientated, a pair of hand grips being removably couplable to said crank and being grippable by a person seated on said chair.

7. A modular exercise bicycle apparatus comprising:

a frame including;

a central support forming a right triangle and including a first leg and a second leg attached to each other at a right angle and a base attached to and extending between said first and second legs, a first juncture being defined at a juncture of said first and second legs, a second juncture being defined at a juncture of said second leg and said base, a third juncture being defined at a juncture of said first leg and said base;

a first footing being attached to said first juncture and a second footing being attached at said second juncture to retain said central support in a vertical orientation, each of said first and second footings being orientated perpendicular to a plane of said central support;

a third footing being attached to said third juncture and being orientated parallel to said first footing, said third footing supporting said central support in a vertical orientation when said second footing is vertically positioned over said first footing;

a housing being mounted on said central support;

a generator being mounted to said housing;

a crank being mounted on said housing, said crank being positioned adjacent to said second juncture, said crank being mechanically coupled to said generator to generate electricity when said crank is rotated;

a vertical mount being attached to and extending upwardly from said housing;

a seat being removably couplable to said vertical mount to position said seat above said crank, a pair of pedals being removably couplable to said crank, said pedals being engageable by a person seated on said seat, said third footing being grippable by the person seated on said seat;

a horizontal mount being attached to said housing, said horizontal mount being horizontally orientated and extending toward said first juncture when said first and third footings are positioned on a floor surface;

a chair being removably couplable with said horizontal mount when said horizontal mount is horizontally orientated, said chair facing said crank, a pair of hand grips being removably couplable to said crank and being grippable by a person seated on said chair; and an inverter being electrically coupled to said generator to convert direct current produced by said generator into alternating current, a male electrical plug being electrically coupled to said inverter and being configured to be plugged into an electrical outlet.

* * * * *